US005357893A

United States Patent [19]

Ruffa

[11] Patent Number: 5,357,893

[45] Date of Patent: Oct. 25, 1994

[54] SNAP LOAD SUPPRESSION SYSTEM

[75] Inventor: Anthony A. Ruffa, Niantic, Conn.

[73] Assignee: The United States of America as represented by the Secretary of the Navy, Washington, D.C.

[21] Appl. No.: 130,405

[22] Filed: Oct. 1, 1993

[51] Int. Cl.[5] ..... B63G 8/14

[52] U.S. Cl. ..... 114/245; 114/244

[58] Field of Search ..... 114/244, 245, 243, 242, 114/253; 441/133; 174/101.5

[56] References Cited

U.S. PATENT DOCUMENTS

| | | | |
|---|---|---|---|
| 2,607,842 | 8/1952 | Reid | 441/133 |
| 2,751,703 | 6/1956 | Kietz et al. | 114/245 |
| 3,795,759 | 3/1974 | Rhyne | 174/101.5 |
| 3,885,515 | 5/1975 | Caldwell, Jr. et al. | 114/244 |
| 4,313,392 | 2/1982 | Guenther et al. | 114/244 |

FOREIGN PATENT DOCUMENTS

| | | | |
|---|---|---|---|
| 885079 | 9/1943 | France | 114/244 |

*Primary Examiner*—Edwin L. Swinehart
*Attorney, Agent, or Firm*—Michael J. McGowan; Prithvi C. Lall; Michael F. Oglo

[57] ABSTRACT

A relatively short cable connects a surface vessel with an underwater vehicle such that the cable does not assume a linear or straight path, but is instead provided with an arcuate shape to avoid snap loads in the cable. Floatation devices are secured to spaced locations on the cable to provide this non-linear cable configuration. The devices are balloons that exert restoring forces on the cable as required to avoid snap loads as the surface vessel heaves up and down due to wave action or the like.

2 Claims, 1 Drawing Sheet

SNAP LOAD SUPPRESSION SYSTEM

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to alleviating the transient loads on a towing cable provided between a surface vessel and an underwater vehicle, and deals more specifically with a means for accommodating a relatively short cable between the surface vessel and the underwater vehicle so as to avoid snap loads on the cable caused by the alternate lack of tension and tension loads created by the heaving motion of the surface vessel in a sea state with significant wave formation.

(2) Description of the Prior Art

Snap loads are a significant problem when towing heavy underwater bodies. Such tow systems are characterized by a tow cable of short scope with very little curvature since the cable shape is dominated by the body weight. In addition, the short cable leads to a very large incidence angle, that is the angle formed by the cable and the horizontal.

As the ship heaves downward due to wave motion, the cable becomes slack, and the body goes into free fall. When the ship heaves upward the cable suddenly becomes taut with the result that the towing vessel and the towed body or vehicle have different and perhaps opposite vertical velocity components. While this motion may tend to stretch the cable the inertia of both the ship and the towed body are brought to zero in a very short time as a result of a surge in cable tension (the snap load). Snap loads are particularly troublesome when the cable scope is relatively short as is generally the case for heavy underwater bodies being towed. The short cable has very little stretch because of its length.

Present systems for suppressing snap loads generally function by keeping the cable taut by compensating for this heaving motion of the towing vessel. Such systems have the drawback of causing cable fatigue at the point of contact between the tension reducing system and the cable itself.

The provision for buoys on floating cables is well known. However, these buoys are not designed to suppress snap loads in a tensioned or taut cable. They are generally used only to keep the cable afloat or to maintain it at a desired depth. Two patents that are exemplary of this general concept of floating cables are 3,698,348 and 4,313,392.

More typical for suppressing snap loads and towing cables are more complicated devices such as those shown in U.S. Pat. Nos. 4,964,491 and 5,140,927. The '491 patent discloses a system for alleviating snap load intensity by providing a spring hydraulic hooking device that deflects when a snap load is imposed on the cable. The '927 patent discloses a motion compensating and tension control system for the surface vessel, the cable being supported at the submersible vessel by a carriage with spring restrained motion that is intended to compensate for wave induced surface vessel motion.

SUMMARY OF THE INVENTION

It is a general purpose and object of the present invention to provide a form of distributed buoyancy along a relatively short and generally taut towing cable. The buoyancy of the cable is preferably implemented selectively by attaching floatation devices to the towing cable at regular intervals. These floatation devices are preferably attached to the cable as it is being deployed by a winch aboard the surface vessel. Each buoyant device will displace an equivalent volume of water so that a buoyant device of one cubic meter in volume will have a buoyant force in sea water somewhat in excess of one thousand kilograms.

The buoyant devices serve to increase the curvature of the cable. When the cable goes from a slack state to a taut state, curvature reduces and/or eliminates the snap load because the upward inertia of the surface vessel must first act to straighten the cable completely before a surge in tension (associated with a sudden stretching of the cable) can occur. The combination of the drag, buoyancy and inertia of several floatation devices acting on the cable will resist the motion necessary to straighten the cable and hence alleviate the snap loads on the cable. Although the floatation devices themselves have very little inertia, there is a significant amount of restoring force exerted by these buoyant devices on the cable due to their added mass, or the mass of surrounding water which must be "pushed" or accelerated by the floatation device as it is accelerated. More specifically, the combined restoring force will be equal approximately to three halves (one and one-half) the weight of the displaced water. The floatation device is preferably of generally spherical shape. Therefore, each floatation device having a diameter of one cubic meter will have a restoring force of approximately fifteen hundred (1500) kilograms acting to resist any reduction in cable curvature.

The restoring forces on the resulting curved configuration of the cable are several orders of magnitude greater than that possible with a cable having no such floatation devices. That is with a linearly configured cable of short scope towing a relatively heavy object only very slight restoring forces can be achieved.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
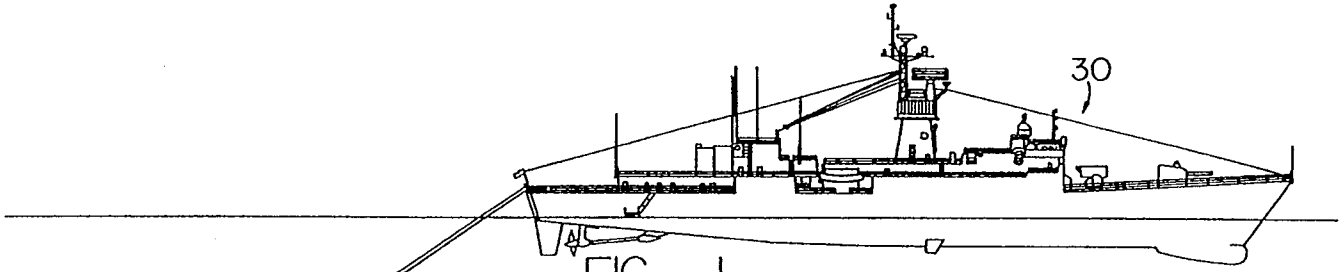
FIG. 1 shows a surface vessel towing an underwater vehicle by means of a relatively short scope cable.
Figure 2:
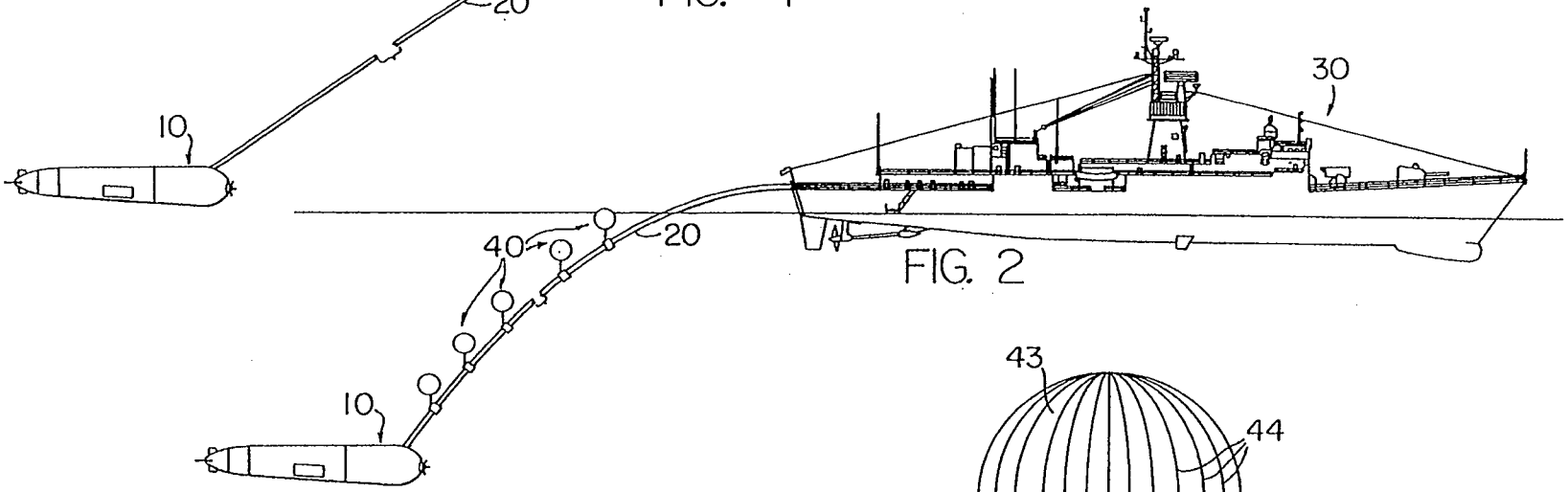
FIG. 2 is a view similar to FIG. 1, but showing the short scope cable fitted with floatation devices in accordance with the present invention.

Referring now to FIG. 2 in greater detail a relatively heavy submersible vehicle or tow body 10 is provided at one end of a towing cable 20. The surface vessel 30 is provided with means for supporting the opposite end of the cable for purposes of towing the submersible vehicle. The cable may include electrical and/or fiber optic components which will carry signals to and from the submersible vehicle from the surface vessel. It is important to avoid snap loads on this cable and to avoid jerking of the submersible body as a result of such snap loads on the cable.

In accordance with the present invention at least one and preferably a plurality of buoyant devices 40 are secured at spaced locations along the cable as shown in FIG. 2. These floatation devices serve to create a curved shape for the towing cable for the purpose of preventing a sudden stretch of the cable as it goes from being slack to being taut, i.e., instead of being stretched, the cable is straightened (its curvature is reduced).

Each of the floatation devices 40 preferably comprises a balloon or bladder that is pressurized with a gas, as for example air. Each floatation device is approximately spherical in shape. The floatation devices are pressurized so they do not shrink in volume significantly due to being towed at a depth below the surface of the water. For example, if a floatation device is to be towed at a depth of two hundred feet it might be pressurized to approximately one hundred pounds per square inch, or at least the hydrostatic pressure of the water at two hundred feet below the surface. The floatation devices are pressurized and each one is clamped to the towing cable by a clamp 46 as it is being deployed. For example, after deploying one hundred feet of cable the winch is stopped and a floatation device is pressurized and clamped to the cable. The floatation devices are preferably made from a high strength laminated polymer film 43 as for example a laminated polyethylene film consisting of layers of LDPE (low-density polyethylene) and strain hardened HDPE (hard-density polyethylene).

Figure 3:
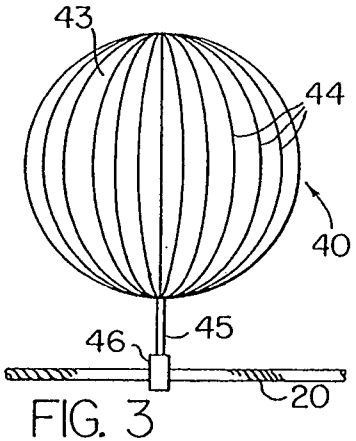
FIG. 3 is a detailed view of one of the several floatation devices secured to the cable.

With particular reference to FIG. 3 each floatation device is tethered to the towing cable by a high strength rope material 45 preferably braided from fibers such as SPECTRA or KEVLAR. The individual fibers in this braided cable may be imbedded between layers of the laminated film as shown at 44 to evenly distribute the pivoting forces on the floatation device. Each tether terminates in the clamp 46 which is readily attached to or removed from the cable.

The effectiveness of the invention depends in part on the combined effects of the buoyancy of the floatation devices 40, as well as the restoring force of the floatation devices acting on the cable 20 due to their added mass, or the mass of the surrounding water that is accelerated due to their motion. The buoyancy of several floatation devices spaced along a typical towing cable induces a cable curvature that simulates the effect of a relatively long cable that might itself be capable of withstanding the vertical motions of the surface vessel. The device of subject invention prevents a sudden stretching of the cable (which leads to a surge in tension) as the cable goes from a slack state to a taut state. The curvature induced by the large buoyancy of the floatation device leads to increased compliance, because the cable must straighten before it stretches. The large buoyancy and added mass associated with each floatation device (i.e., the mass of surrounding water that is "pushed" or accelerated due to acceleration of the floatation device) act to prevent reduction of cable curvature. Therefore, it is unlikely that the cable will straighten completely due to upward heaving motions of the surface vessel. Because of this, the sudden cable stretching and the associated surge in the tension are eliminated and/or greatly reduced.

As shown in FIG. 2, the balloons 40, 40 resist straightening of the towing cable 20 and therefore readily absorb the energy imposed on the system by the vertically heaving surface vessel operating in heavy sea conditions.

In light of the above, it is therefore understood that within the scope of the appended claims, the invention may be practiced otherwise than as specifically described.

What is claimed is:

1. A snap load suppression system for use between a surface vessel and an underwater towed vehicle and comprising:

cable means having first portion adapted to be secured to the towing vessel and a second portion adapted to be secured to the towed vehicle; and a cable segment provided between said first and said second portions, said cable segment normally being in tension with a plurality of floatation devices secured to said cable segment at locations spaced from one another on said cable segment and remote from said first and said second portions thereof, said plurality of floatation devices comprising inflatable balloons that are each inflated to gas pressures corresponding to different underwater depths, whereby said tensioned cable segment assumes a curved configuration such that heaving of the towing vessel at the surface cannot cause sudden cable tension changes with the result that snap loads on the cable and hence on the towed underwater vessel are avoided.

2. The method for creating a curved shape in a relatively short towing cable provided between a surface vessel and an underwater vehicle, said method comprising the steps of securing the cable to the underwater vehicle and deploying the cable from a winch aboard the surface vessel in increments, inflating a plurality balloons to gas pressures dictated by the design depth water pressure for particular cable locations, and attaching said plurality of balloons to the cable at such locations spaced along the cable whereby the cable is provided with a curved configuration having a high resistance to any reduction in curvature, thereby avoiding a sudden cable tension changes in the cable and hence avoiding snap loads upon the cable and upon the underwater vehicle.

* * * * *